US005165782A

United States Patent [19]

Maglica et al.

[11] Patent Number: 5,165,782

[45] Date of Patent: Nov. 24, 1992

[54] SHOCK ABSORBING LENS HOLDER AND ANTI-ROLL DEVICE

[75] Inventors: Anthony Maglica, Anaheim; Fred R. McAlister, Riverside, both of Calif.

[73] Assignee: Mag Instrument, Inc., Ontario, Calif.

[21] Appl. No.: 818,751

[22] Filed: Jan. 8, 1992

[51] Int. Cl.[5] ..... F21L 15/00

[52] U.S. Cl. ..... 362/208; 362/202; 362/390; 362/457

[58] Field of Search ..... 362/157, 186, 189, 190, 362/202, 208, 390, 457

[56] References Cited

U.S. PATENT DOCUMENTS

| | | | |
|---|---|---|---|
| 1,834,214 | 11/1933 | Stinison | 362/208 |
| 2,309,687 | 2/1943 | Wood | 362/208 |
| 3,114,143 | 12/1963 | Robinson | 362/186 |
| 3,258,589 | 6/1966 | Doring | 362/208 |
| 3,368,069 | 2/1968 | Trott | 362/186 |

*Primary Examiner*—Richard R. Cole

*Attorney, Agent, or Firm*—Lyon & Lyon

[57] ABSTRACT

A molded thermal plastic accessory cover attaching to the head assembly of a flashlight provides inwardly extending ribs to seat on the flashlight and to provide shock absorbing characteristics. A seat is provided for an auxiliary lens and the outside of the cover includes flat surfaces to inhibit rolling of the assembled cover and flashlight.

6 Claims, 2 Drawing Sheets

SHOCK ABSORBING LENS HOLDER AND ANTI-ROLL DEVICE

BACKGROUND OF THE INVENTION

The field of the present invention is accessory devices for flashlights.

Flashlights come in a variety of shapes and sizes. A common design in the art comprises a barrel-shaped body with a cylindrical head assembly. This design best accommodates standard, cylindrical batteries as the power source of the flashlight. The head assembly typically contains a lamp covered by a clear lens, the lens being recessed from the outermost end of the head assembly to help protect it by reducing its exposure to contact with foreign objects.

It is often desirable to change the color or intensity of the light emitting from a flashlight. A known method of accomplishing this is to remove the clear lens from the head assembly and insert a particular colored lens in its place. However, this method can be cumbersome and time consuming. Another method is known whereby a colored, accessory lens is placed over the existing lens at the end of the head assembly and secured by a "lens holder" device.

It is also desirable to prevent a flashlight from rolling along a surface. A known method of accomplishing this is to equip the head assembly with an attachment accessory having a plurality of flat sides which inhibit the flashlight from rolling. This attachment, or "anti-roll" device is typically made of molded plastic or rubber material and is designed to fit over a cylindrical flashlight head assembly.

It is further known to combine the utility features of a lens holder with those of an anti-roll attachment in a single flashlight accessory device

SUMMARY OF THE INVENTION

The present invention is directed to combining the features of an anti-roll accessory device with means for absorbing shock caused by droping or other impact, thereby providing protection to the lamp lens and other components of the head assembly, but doing so with minimum material requirements and complexity.

According to a first aspect of the present invention, a flashlight accessory device is provided which forms a cover for the head of a flashlight. A hollow cylindrical body open at each end is provided with multiple flat sides and ribs extending inwardly about the inner periphery of the body. The ribs extend to receive the flashlight head and provide energy absorbing characteristics to protect against physical shock.

In a second aspect of the present invention, such a flashlight head cover includes an inwardly extending flange having a first shoulder for abutting against one end of the flashlight head, a second shoulder for receiving a secondary lens such as a colored lens and an annular seat having an interlocking structure spaced from the second shoulder so as to be capable of retaining a secondary lens in position.

Thus, it is an object of the present invention to provide an improved head cover for a flashlight. Other objects and advantages will appear hereinafter.

DETAILED DESCRIPTION OF THE PREFERRED EMBODIMENT

Figure 1:
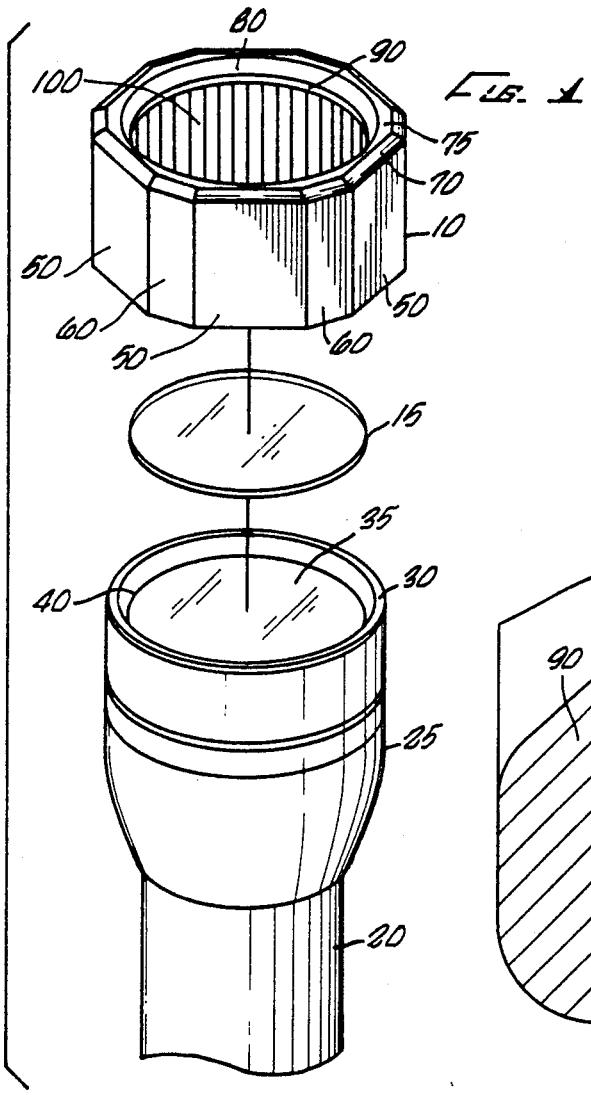
FIG. 1 is an exploded perspective view of a flashlight and a flashlight head cover of the present invention.

Turning in detail to the drawings, a flashlight head cover 10 is shown retaining a color lens 15 on a flashlight 20. The flashlight has a cylindrical head assembly 25 with an outer wall 30 and a clear lens 35. The lens 35 is mounted within a recess 40 of the head assembly. Other components within the head assembly, such as a lamp and reflector, are not illustrated. The cover is integrally formed of molded resilient plastic or rubber. The resilience and softness of the material employed are preferably selected to improve shock characteristics and durability.

The cover 10 has multiple flat, rectangular external sides to form a ring-like structure. The sides include wide sides 50 and narrow sides 60 in an alternating pattern to form a cylindrical multi-faceted body 65. The body is hollow, being open at each end. There are six wide sides 50 giving the cover a hexagonal look. The narrow sides are provided at the corners of this hexagon. The sides are useful in inhibiting the rolling of a flashlight when positioned on a flat surface.

The cover 10 has a first end defined by inwardly sloping portions 70 adjacent to each flat side 50 and 60. Inwardly of the sloping portions there is a uniform flat top surface 75. Inwardly therefrom is an inwardly concave surface 80. This end extends inwardly as a flange 90. The flange 90 includes a stop 95 which is substantially cylindrical, extending to a first shoulder 96 against which the head assembly wall 30 abuts to locate the cover 10. The flange 90 also includes a second shoulder 97 for receiving an accessory lens 15. the second shoulder 97 is angled inwardly as can best be seen in FIG. 5. This angle creates a lip seal for sealing the accessory lens 15 to prevent moisture and dirt from entering into the area between the accessory lens 15 and the primary lens 35.

Figure 5:
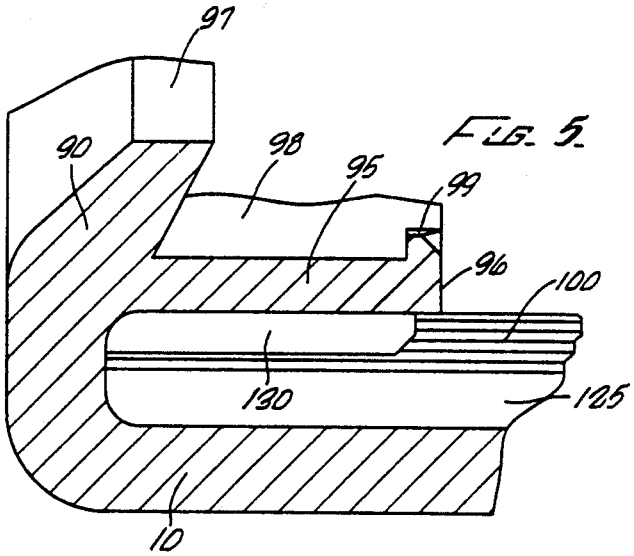
FIG. 5 is a cross-sectional side detail view taken along line 5—5 of FIG. 4.
Figure 2:
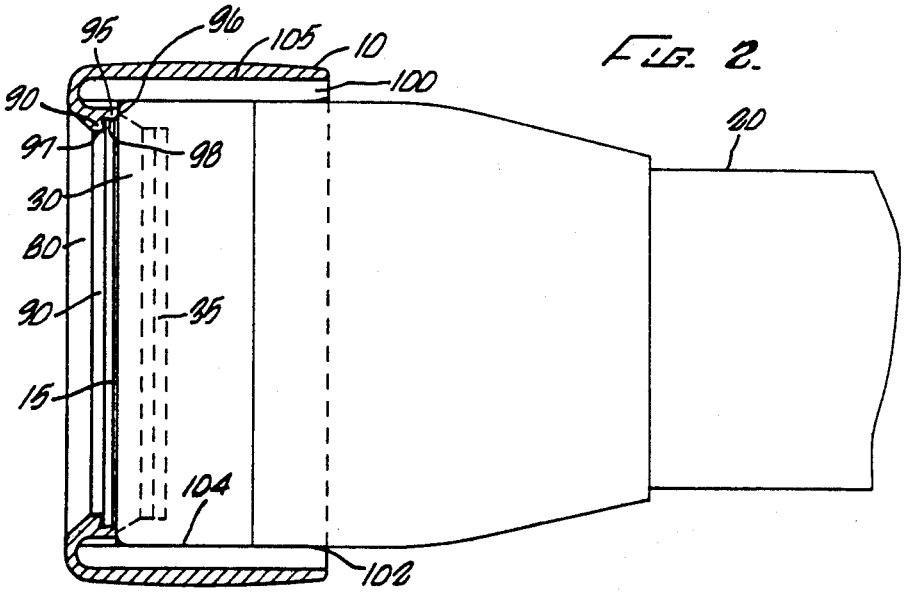
FIG. 2 is a cross-sectional side view of the cover with a flashlight shown in place taken along line 2—2 of FIG. 3.
Figure 3:
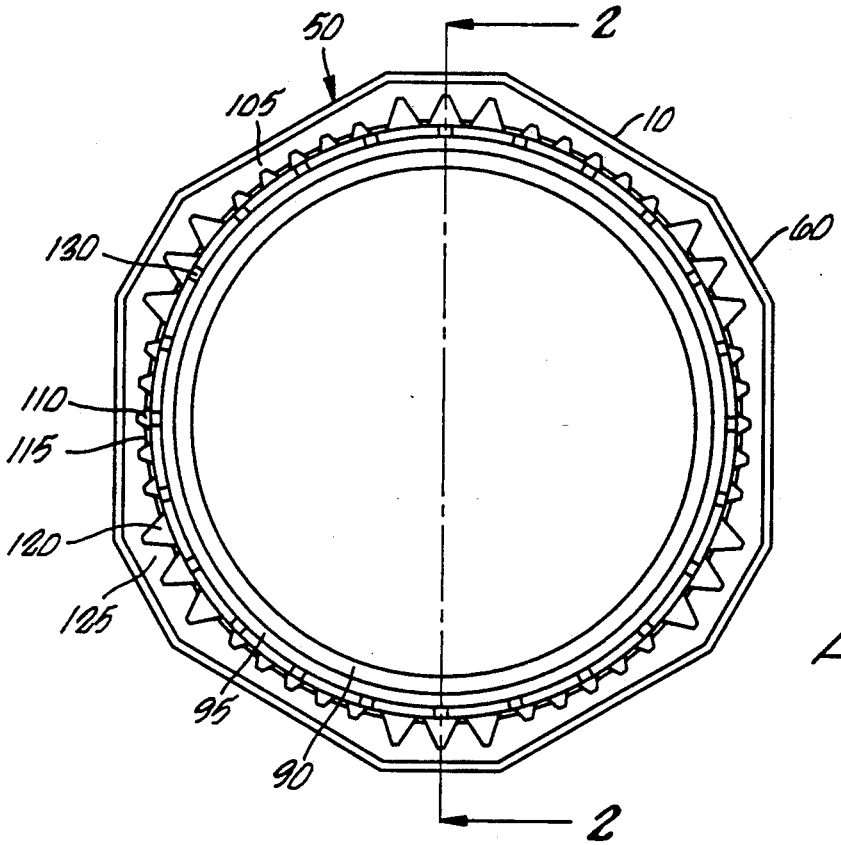
FIG. 3 is a bottom view of the flashlight head cover.
Figure 4:
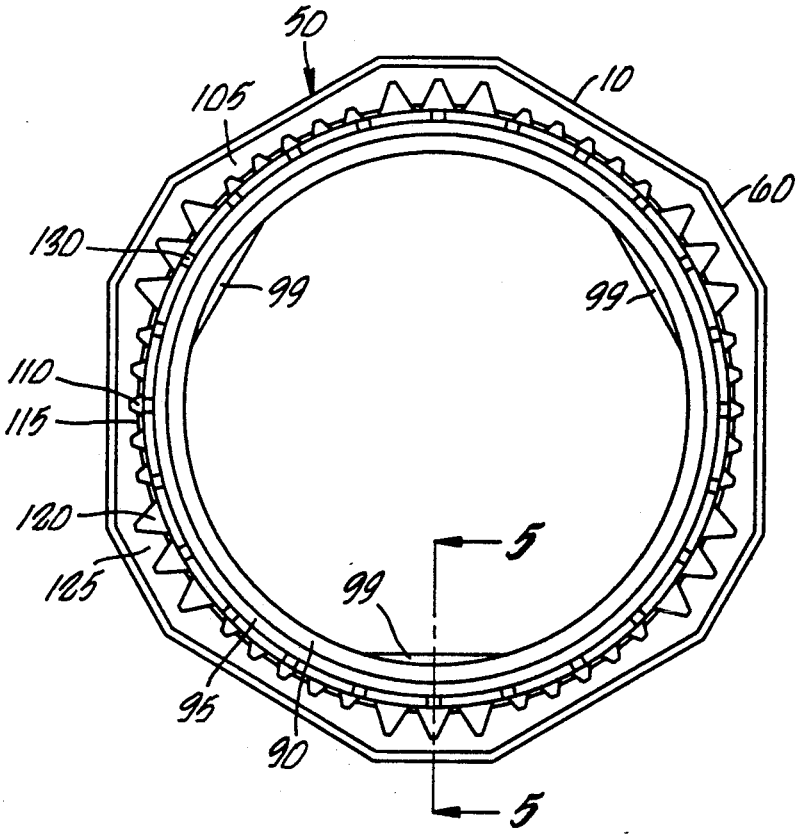
FIG. 4 is a bottom view of the flashlight head cover illustrating locking members to retain a secondary lens.

In between the first shoulder 96 and the second shoulder 97 is an annular seat 98. The annular seat 98 extends from the outer end of the first shoulder 96 to the inner end of the second shoulder 97. This seat 98 is arranged such that the end adjacent to the first shoulder has an interlocking configuration. In the embodiment illustrated in FIG. 2, the seat is tapered inwardly away from the second shoulder 97. This results in an undercut seat retain the lens 15 abutting against the second shoulder 97. In FIG. 5, the seat 98 is cylindrical with retainers 99 extending inwardly and spaced from the second shoulder 97.

The interior of the hollow cylindrical body 65 includes a plurality of ribs 100 extending inwardly. The ribs 100 have a tapered portion 102 to facilitate insertion of the head assembly 25 into the cover 10. The ends of the ribs 100 terminate at a surface of rotation which, in the preferred embodiment, is a circular cylinder. This surface of rotation approximates the surface of the flashlight head and is preferably slightly smaller than the flashlight head to insure an interference fit between the cover 10 and the flashlight head 25. As the hollow cylindrical body 65 may be considered to have a substantially uniform wall thickness 105, the ribs 100 are of varying heights so as to extend to the surface of rotation defined above. On the wide sides 50, small pitch serrations 110 define the ribs 115 while the narrow sides 60 have large pitch serrations 120 to define larger ribs 125.

The inwardly extending flange 90 is shown to extend downwardly with rectangular bosses 130 extending outwardly from the flange. These bosses 130 assist in insuring proper location of the flashlight head 25, help rigidify the cylindrical stop 95 and provide shock absorbing properties to the structure against impact.

When the cover 10 is placed over the head assembly 25 of a flashlight 20, that portion of the wall 30 which extends beyond the flashlight lens 35 extends through and abuts against the inwardly extending flange 90 and the stops 130. The head 25 is retained in interference fit by the ribs 100. If the flashlight is dropped on the head assembly or otherwise struck, the cover provides means for reducing the force that translates to the components of the head assembly. This protection is provided about the periphery of the head and on the end of the head assembly.

Thus, a cover capable of protecting the head of a flashlight, providing anti-roll characteristics and providing a seat for an auxiliary lens is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A cover for a head of a flashlight, comprising a hollow cylindrical body open at each end to receive a flashlight head and having multiple flat sides about an outer periphery thereof;

ribs extending inwardly from an inner periphery of said hollow cylindrical body, an inner extent of said ribs terminating at a surface of rotation approximating an outer surface of a flashlight head to be received in said hollow cylindrical body;

an inwardly extending flange at one end of said hollow cylindrical body to receive an end of a flashlight head positioned in said hollow cylindrical body.

2. The cover of claim 1 wherein said inwardly extending flange is circular about its inner periphery and includes a first shoulder on one side thereof to receive a flashlight head, a second shoulder extending inwardly from said first shoulder and an annular seat extending from a first end at said first shoulder to a second end at said second shoulder, said annular seat providing means displaced from said second shoulder for retaining a lens in said annular seat abutting against said second shoulder.

3. The cover of claim 2 wherein said means for retaining a lens in said annular seat includes retainers extending inwardly from said annular seat and displaced from said second shoulder.

4. The cover of claim 1 wherein said hollow cylindrical body is of substantially uniform wall thickness, said ribs being of varying heights.

5. The cover of claim 1 wherein said multiple flat sides include six wide sides alternating with six narrow sides.

6. A cover for a head of a flashlight, comprising a hollow cylindrical body open at each end to receive a flashlight head and having multiple flat sides about an outer periphery thereof, said hollow cylindrical body being of substantially uniform wall thickness;

ribs extending inwardly from an inner periphery of said hollow cylindrical body, an inner extent of said ribs terminating at a surface of rotation approximating an outer surface of a flashlight head to be received in said hollow cylindrical body said ribs being of varying heights;

an inwardly extending flange at one end of said hollow cylindrical body to receive an end of a flashlight head positioned in said hollow cylindrical body, said inwardly extending flange being circular about its inner periphery and including a first shoulder on one side thereof to receive a flashlight head, a second shoulder extending inwardly from said first shoulder and an annular seat extending from a first end at said first shoulder to a second end at said second shoulder, said annular seat providing means displaced from said second shoulder for retaining a lens in said annular seat abutting against said second shoulder.

* * * * *